US006550491B1

(12) United States Patent
Bixler et al.

(10) Patent No.: US 6,550,491 B1
(45) Date of Patent: Apr. 22, 2003

(54) PORTABLE STRUCTURE

(75) Inventors: Dickie R. Bixler, Alva, OK (US); Larry D. Lahman, Enid, OK (US)

(73) Assignee: World Patent Development Corporation, Enid, OK (US)

( * ) Notice: Subject to any disclaimer, the term of this patent is extended or adjusted under 35 U.S.C. 154(b) by 0 days.

(21) Appl. No.: 09/461,695

(22) Filed: Dec. 14, 1999

(51) Int. Cl.[7] ..... E04H 15/48; E04H 15/50; E04H 15/52; A63B 69/00

(52) U.S. Cl. ..... 135/145; 135/144; 135/157; 135/912; 135/121; 52/64; 52/79.5; 52/143; 52/646; 473/421

(58) Field of Search ..... 135/143, 144, 135/145, 121, 128, 912, 137, 139, 148, 149, 157; 52/64, 109, 79.5, 143, 646, 641, 71; 473/421

(56) References Cited

U.S. PATENT DOCUMENTS

| | | | | |
|---|---|---|---|---|
| 684,130 A | * | 10/1901 | Taubert | |
| 907,032 A | * | 12/1908 | Cohen | |
| 1,410,830 A | * | 3/1922 | O'Neal | |
| 1,591,753 A | | 7/1926 | Flaugh | |
| 2,393,415 A | * | 1/1946 | Rosenfeld | |
| 2,486,170 A | * | 10/1949 | Kavanaugh | 135/912 X |
| 2,923,547 A | | 2/1960 | Heeremans | |
| 3,064,667 A | * | 11/1962 | Marino | 135/912 X |
| 3,131,705 A | * | 5/1964 | Marino | 135/912 X |
| 3,256,896 A | | 6/1966 | Cummins | |
| RE26,215 E | * | 5/1967 | Usher et al. | |
| 3,354,596 A | * | 11/1967 | Schafer | |
| 3,541,626 A | | 11/1970 | Eggert, Jr. | |
| 3,644,952 A | | 2/1972 | Hatch | |
| 3,807,421 A | | 4/1974 | Geiger et al. | |
| RE30,044 E | | 7/1979 | Huddle | |
| 4,649,947 A | | 3/1987 | Tury et al. | |
| 4,815,736 A | | 3/1989 | Wright | |
| 4,844,109 A | * | 7/1989 | Navarro | 135/103 |
| 4,890,834 A | * | 1/1990 | Ponza | |

(List continued on next page.)

FOREIGN PATENT DOCUMENTS

| | | | | |
|---|---|---|---|---|
| FR | 355137 | * | 2/1992 | 135/144 |
| JP | 404052386 | * | 2/1992 | 135/145 |

*Primary Examiner*—Robert Canfield
(74) *Attorney, Agent, or Firm*—Fellers, Snider, Blankenship, Bailey & Tippens, P.C.

(57) ABSTRACT

The present invention is a portable structure used for exhibition or sports (batting cage) applications including an expansion section with a plurality of expansion segments, each of which is self-contained. Each expansion segment is bounded by an upright member onto which an articulating arm is attached adjacent the tope and bottom. Each articulating arm bends at an elbow and folds flat against the upright members when each expansion segment is extended, the articulating arms straighten at the elbow and pivot in a scissor-type motion with respect to the upright members until the articulating arms are fully extended substantially straight. The expansion segments roll on rollers removably affixed to the upright members. The portable structure includes three positions, a transport position wherein large wheels or skids are suppled for easy manipulation of the device, an expansion segment wherein the expansion segments are extended or collapsed using smaller wheels. Once fully extended, the smaller wheels are likewise removed in a structural position wherein the structure is resting on and supported from the ground. A storage container may be added to store the netting or fabric used to enclose the extended expansion section to form an enclosed structure. A foldable platform may be installed in the extension segment.

9 Claims, 10 Drawing Sheets

U.S. PATENT DOCUMENTS 4,912,887 A * 4/1990 Sullivan ..... 52/7
5,050,353 A * 9/1991 Rogers et al. ..... 52/8
5,056,782 A 10/1991 Giovagnoli
5,243,803 A * 9/1993 Tabata et al. ..... 52/646
5,263,507 A * 11/1993 Chuang ..... 135/107
5,331,777 A * 7/1994 Chi-Yuan ..... 52/64
5,370,385 A * 12/1994 Joy
5,421,356 A * 6/1995 Lynch ..... 135/145
5,634,638 A 6/1997 Havens et al.
5,655,766 A 8/1997 Klebe, Jr.
5,839,462 A * 11/1998 Randall ..... 135/128
6,125,483 A * 10/2000 Stroud et al. ..... 135/128 X

* cited by examiner

PORTABLE STRUCTURE

BACKGROUND OF THE INVENTION

FIELD OF THE INVENTION

The present invention relates generally to portable structures, include a portable metal frame, and more particularly to sporting enclosures to include batting cages.

BACKGROUND OF THE INVENTION

Portable shelters including expandable metal frames covered by flexible fabric have been known for many years and include camping and other related lawn tents. These structures are very portable and easy to erect, however, they are limited in size and structural integrity. Larger tents and awnings provide the necessary structural stability but require supporting members of substantial weight which are commonly supported by guy wires secured from stakes driven into the ground. This makes these structures more difficult to erect, less portable and unsuitable for certain applications. A need therefore exists for a structure which includes an expandable frame which is portable yet provides the requisite structural integrity.

Sporting structures such as batting cages have become an essential training apparatus for the competitive athlete. Such structures allow batting and/or throwing practice without the necessity of another person to throw or catch the ball. In order for an athlete to remain competitive, that athlete must practice hitting and/or throwing on a regimented basis.

When a baseball team is traveling, such as for a tournament or post-season series, it is often difficult to schedule sufficient time in the hosting venues facilities to maintain top competitive form. Traditional batting cages are not structures conducive to portable transport. The above-described problems are not unique to baseball. Other sports such as softball, golf, and hockey have similar difficulties.

The art contains some disclosures of sports enclosures which are represented to be portable, however, they are found to be cumbersome, heavy and difficult to set up and take down. A need therefore exists for a portable structure for use in sports training which is compact for storage or transport yet can be expanded so as to be efficient for a competitive training regimen.

SUMMARY OF THE INVENTION

A portable structure for defining an enclosed sports apparatus, shelter structure, or to create booths for festival use, such as arts festivals is herein described. The portable structure of the present invention includes, most generally, an expansion section which is comprised of numerous component expansion segments, each of which is expanded and collapsed independently of the others. The segmented form allows the entire expansion section to be expanded or collapsed without dismantling the structure or any of the component expansion segments.

Each expansion segment includes adjacent upright members with at least one articulating arm extending therebetween. Each articulating arm is capable of pivoting at an elbow and with respect to the upright member such that when the portable structure is expanded and one upright member extended from its adjacent upright member, each articulating arm pivots at the elbow and with regard to each upright member in a scissor type motion so as to expand to a maximum length wherein each articulating arm is substantially horizontal and pivotally supported by an upright member on each end. The component expansion segments are sequentially expanded to the maximum length of the portable structure. Once the expansion section is completely extended, the structure is further supported using an outrigger extending from each upright member. The upright members are then expanded horizontally and then vertically and locked in the proper width and height positions. In order to retract or collapse the expansion section, the process is performed in reverse order to again collapse the portable structure to its transport/storage state.

The portable structure includes three positions, a transport position wherein large transport wheels (or skids) are employed for ease of maneuverability of the entire collapsed structure. A second position is an expansion position wherein a plurality of smaller wheels secured to each upright member are used to extend the component expansion segments. A third position is the structural position wherein the smaller wheels are removed and the device rests on the ground providing structural integrity without the use of stakes or other such devices.

The portable structure may also include a storage container into which an outer netting or fabric covering may be stored for extension over the entire expanded extension section and secured thereon to achieve an enclosed structure. A folding platform may also be stored within the storage container and then folded out or extended.

It is, therefore, an object of the present invention to provide a portable structure which collapses to a compact size for storage or transport and expands to a size suitable for shelter and/or sports applications.

It is a further object of the present invention to provide a portable structure which is self contained.

It is still a further object of the present invention to provide a portable structure which may be expanded or collapsed without dismantling the structure.

It is yet an additional object of the present invention to provide a portable structure which is expanded on a segmented basis.

It is another object of the present invention to expand the segmented sections using articulating arms in a scissor-type motion.

It is yet another object of the present invention to provide a portable structure which includes a transport position, expansion position, and structural position.

DETAILED DESCRIPTION OF THE PREFERRED EMBODIMENT

Figure 1:
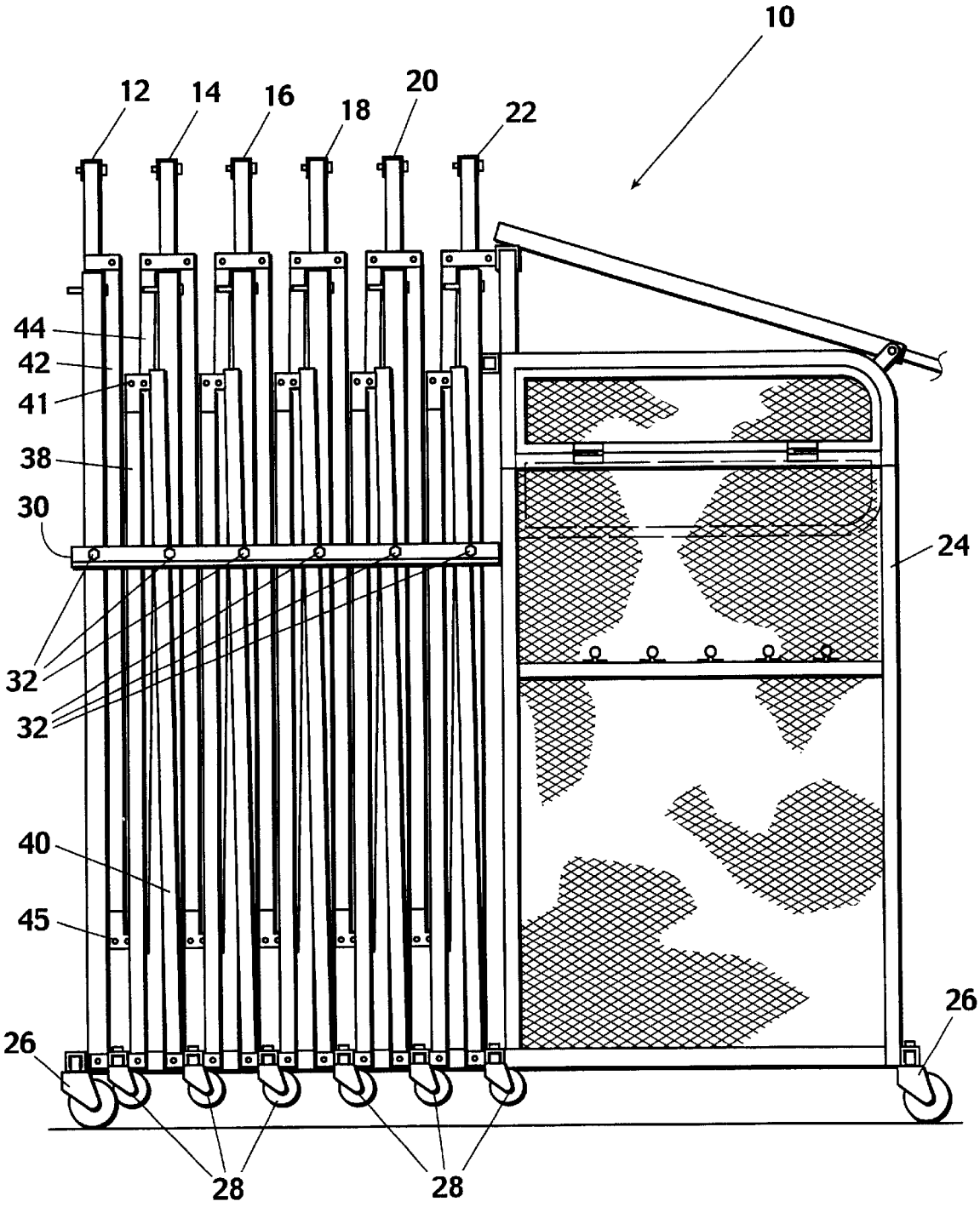
FIG. 1 is a side view of the portable structure of the present invention depicted in the transport position.

The portable structure 10 of the present invention as shown in FIG. 1 includes generally a plurality of upright members 12, 14, 16, 18, 20, and 22, storage container 24, large transport wheels, collectively 26, and smaller expansion wheels, collectively 28. Portable structure 10 is shown is FIG. 1 in the transport position including an expansion section 11 defined by a plurality of expansion segments which are further defined by and between uprights 12 and 14, 14 and 16, 16 and 18, 18 and 20, 20 and 22, and 22 and storage container 24. Expansion section 11 is shown fully retracted or collapsed so as to take up a minimum amount of space (volume) for transport and/or storage. Additionally, in its retracted, transport position, portable structure 10 includes large wheels 26 which allow portable structure 10 to be completely portable either by hand, manipulated, or towed with a slow moving utility vehicle such as a tractor. Large wheels 26 are caster-type so as to be able to rotate (or swivel) 360° thereby providing maximum mobility and ease of transport. In the event that it becomes necessary to transport portable structure 10 a greater distance, it is contemplated that large wheel 26 could be used to manipulate portable structure 10 onto a truck or utility trailer to be towed behind a vehicle.

Large wheels 26 may be substituted with skids for ease of transport of portable structure 10 on grass, gravel, dirt, sand, or the like. Moreover, large wheels 26 are intended only for transport of portable structure 10 and in this transport position and are capable of being removed for expansion of portable structure 10.

In its retracted position, portable structure 10 includes a rigid bar 30 to which uprights 12, 14, 16, 18, 20, and 22 may be secured such as by using of pins, collectively 32. It has been found that cage pins are particularly suitable for this purpose, however, it is understood that other securing means such as bolts could be substituted. Rigid bar 30 and pins 32 prevent expansion section 11 from undesired expansion during transport or storage of portable structure 10.

Figure 2:
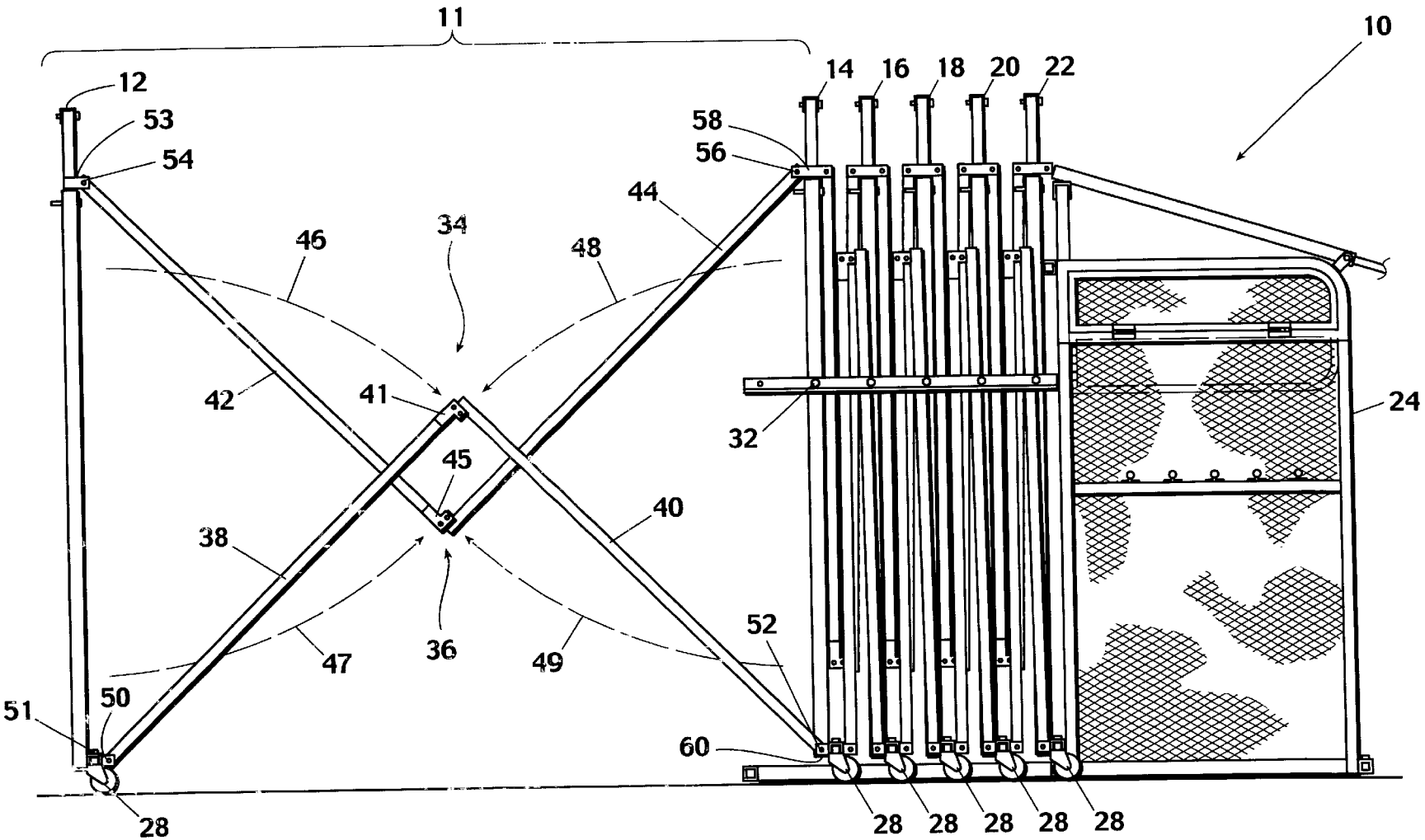
FIG. 2 is the portable structure of FIG. 1 depicted in the expansion position showing a first segment being extended.

Referring next to FIG. 2, the portable structure 10 of FIG. 1 is depicted in an expansion position where the large wheels 26 of FIG. 1 have been removed. In the expansion position, upright members 12, 14, 16, 18, 20, and 22 of expansion segment 11 rest upon their respective smaller wheels 28 while storage container 24 rests on the ground. Large wheels 26 of FIG. 1 may be added or removed by jacking portable structure and removing or adding large wheels 26. Wheels 28 are also preferably of a swivel, caster type.

FIG. 2 depicts a first component segment of expansion section 11 defined between upright member 12 and upright member 14. A pair or articulating arms 34 and 36 extend between upright members 12 and 14.

Each articulating arm such as articulating arm 34, includes a first length 38 and a second length 40. First length 38 and second length 40 are joined at an elbow 41. Likewise, articulating arm 36 includes a first length 42 and a second length 44 joined at an elbow 45.

Referring briefly back to FIG. 1, in the retracted, transport/storage position, wherein upright member 12 is adjacent upright member 14, first segment 38 is articulated against second segment 40 by pivoting at elbow 41. Likewise, first segment 42 is articulated against second segment 44 by pivoting at elbow 45.

Referring again to FIG. 2, when first pin 32 is removed and as upright member 12 is extended away from upright member 14 on wheels 28, arms 34 and 36 are articulated or extended at elbows 41 and 45 in a scissor-type motion. For arm 34, this motion is exemplified by arrows 46 and 48. When upright member 12 is rolled away from upright member 14, elbow 41 pivots such that arm 38 pivots away from upright member 12 at a point 50 along path of travel 46 while second segment 40 pivots away from upright member 14 at a point 52 along path 48. Segments 38 and 40 of articulating arm 34 pivot in a downward direction to ultimately form a substantially straight, horizontal member connected to upright member 12 on one end and upright member 14 on the other.

Likewise, when upright member 12 is extended from upright member 14, articulating arm 36 extends by pivoting at elbow 45. First segment 42 pivots away from upright member 12 at a point 54 following path of travel 47 while second segment 40 pivots from upright member 14 at 56 following path of travel 49. First segment 42 and second segment 44 of articulating arm 36 pivot at elbow 45 upwardly following paths of travel 47 and 49, respectively.

Each upright member, such as upright member 12, includes an upper bracket 53 to which segment 42 is pinned so as to pivot at pivot point 54, and a lower bracket 51 to which first segment 38 of articulating arm 34 is pinned so as to pivot at pivot point 50. Likewise, upright member 14 includes a bracket 58 from which second segment 42 of articulating arm 36 pivots at pivot point 56 while second segment 40 of articulating arm 34 is pinned to a bracket 60 so as to pivot at pivot point 52. Each upright member 12, 14, 16, 18, 20, and 22 are constructed in the same manner.

Figure 3:
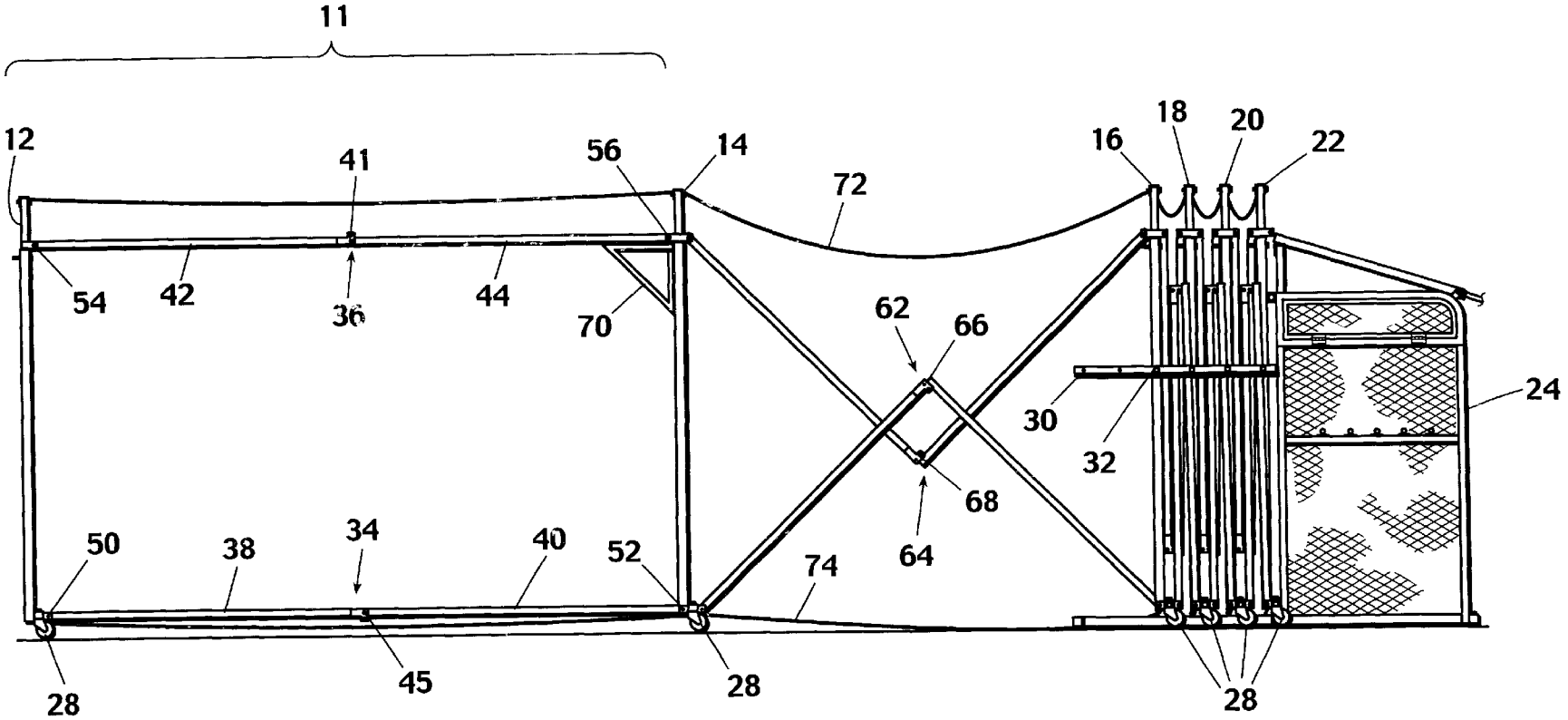
FIG. 3 is the portable structure of FIG. 2 wherein the first segment is shown fully extended and a second segment in the process of being extended.

Referring next to FIG. 3 which shows the portable structure 10 of FIG. 2 wherein the first expansion segment bounded between upright member 12 and upright member 14 is shown fully extended. Articulating arms 34 and 36 are articulated at elbows 45 and 41, respectively, such that articulating arms 34 and 36 are substantially straight therefore providing the maximum length extension between upright member 12 and upright member 14.

Once a first segment, such as the segment between upright member 12 and 14, of expansion section 11 is fully extended as shown in FIG. 3, the second expansion segment between upright members 14 and upright member 16 may be extended after removing second pin 32 using wheels 28 and articulating arms 62 and 64. Articulating arms 62 and 64 are the same construction as articulating arms 34 and 36 and are pivoted at elbows 66 and 68 in identical scissor-type motions so as to likewise fully extend articulating arms 62 and 64 to provide the maximum distance between upright members 14 and 16.

Likewise, the extension segments defined between upright members 16 and 18, 18 and 20, 20 and 22, and 22 and storage cabinet 24 are extended in an identical scissor-type manner so as to fully extend expansion section 11 of portable structure 10.

Additional support may be obtained through the use of triangular upper support brackets 70 which rotate out from hinges secured to the upright members, such as upright member 14 in FIG. 3 and pinned to the upper articulating arm, such as 36. Triangular bracket 70 provides additional structural support to the portable structure 10.

An upper cable system 72 and lower cable 74 may be connected to each upright member and extended therewith. Cable system 72 and 74 is useful in drawing a covering over portable structure 10 such as netting for a batting cage or a protective fabric cover for an exhibition or storage tent. However, it is also intended that such netting or fabric could be manually extended or secured over the frame structure defined by expansion section 11 in a basic embodiment.

Figure 4:
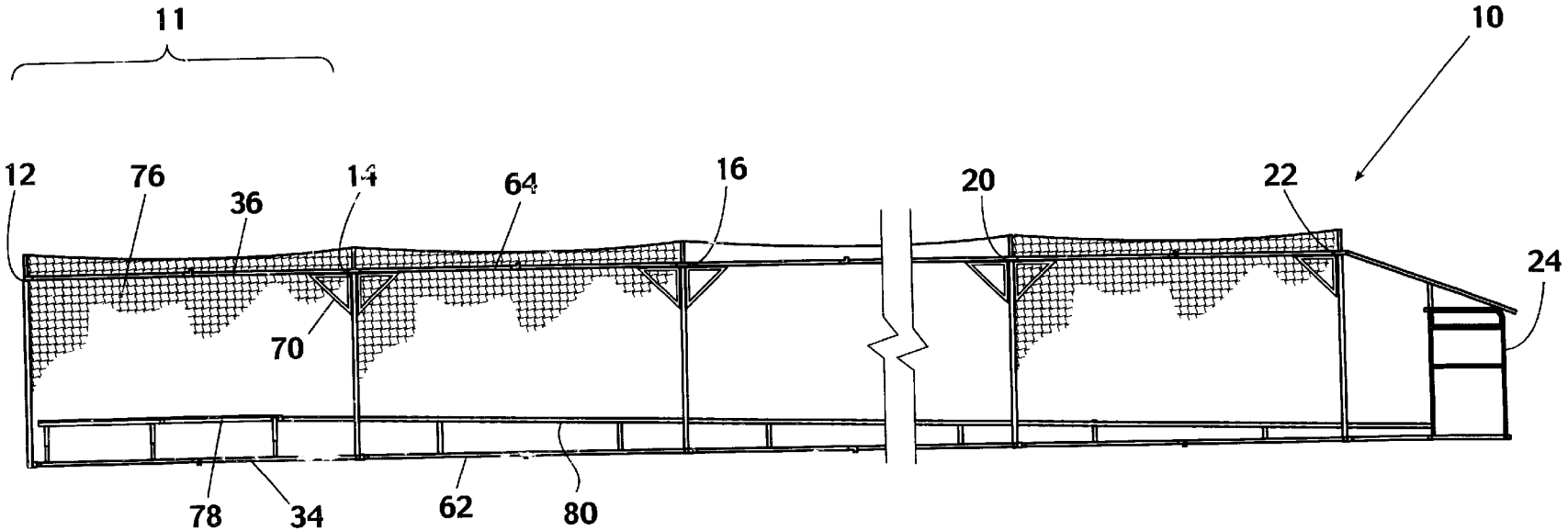
FIG. 4 is a side view of the portable structure of the present invention shown fully extended.

FIG. 4 depicts portable structure 10 from a side view in a fully extended structural position. In the structural position, smaller wheels 28 are removed so that the structure rests on the ground. The portable structure of FIG. 4 is embodied as a batting cage including a netted enclosure 76 completely enshrouding the expansion segment 11. However, it is understood that in the event that portable structure 10 is configured as an exhibition tent, a solid fabric cover may be substituted for netting 76 over expansion section 11 without departing from the spirit and scope of the invention.

A raised, folding platform 78 may be removed from storage within storage cabinet 24 and unfolded inside the netting 76 of expansion section 11. In the batting cage embodiment, a rigid, level batter's platform 78 with a sloping, rigid or preferably flexible fabric surface 80 extending between platform 78 and storage cabinet 24 so that pitched balls may automatically return by gravity back toward storage cabinet 24.

In the embodiment of an exhibition tent, sloped surface 80 could be replaced with a plurality of level folding platforms identical to platform 78 (or a single folded platform) in order to provide a rigid, level exhibition surface within expansion section 11. Alternately, a single accordion folded platform could be stored within storage container 24 are extended for use.

Figure 5:
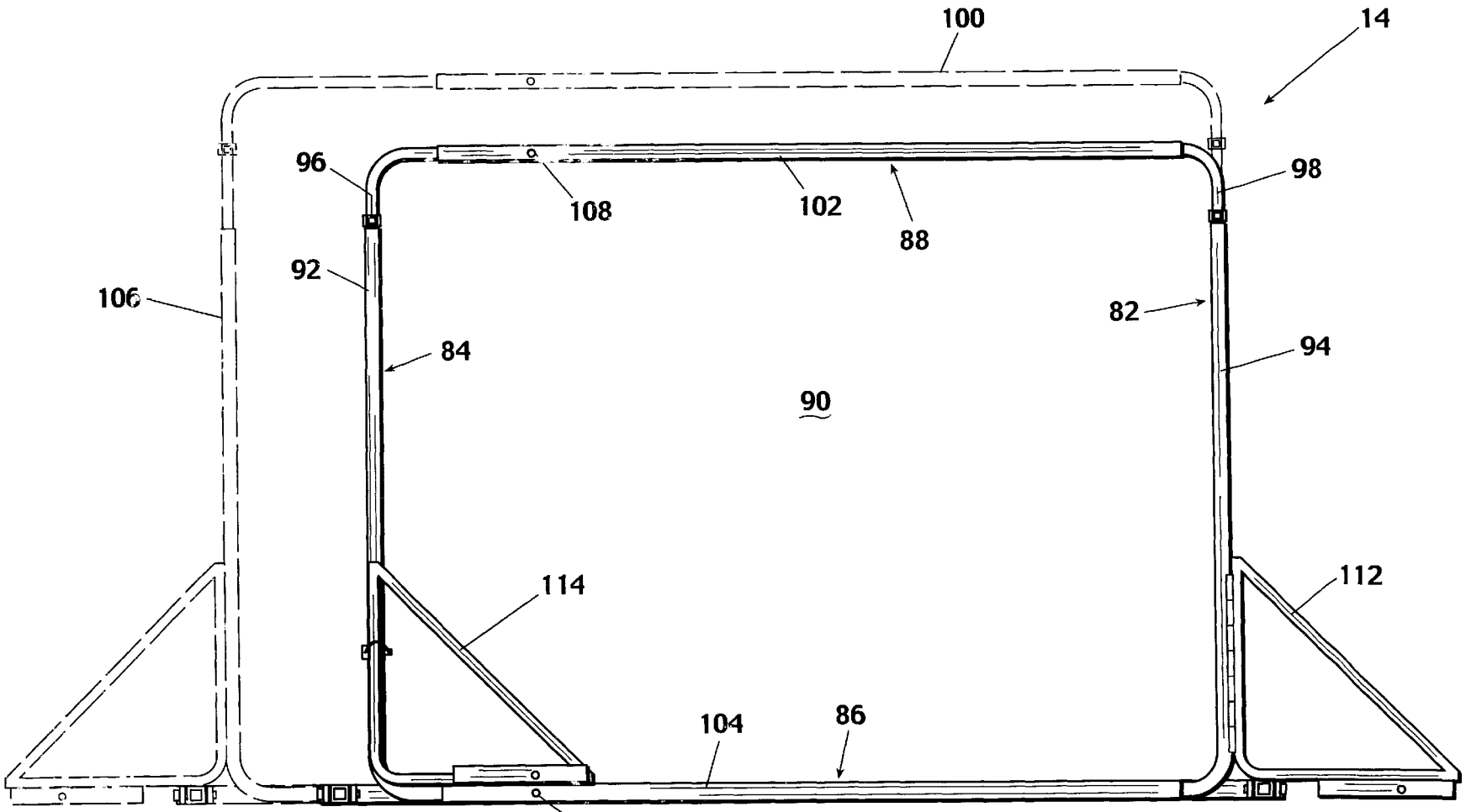
FIG. 5 is an upright detail depicting the manner in which each upright assembly is capable of increase in width and height and including an outrigger assembly.

FIG. 5 is a detail of an upright member such as upright member 14 of FIG. 2. Upright member 14 is shown from a front view in order to disclose the expansion capability of each individual upright member. Each upright member is capable of expanding in height and width once expansion section 11 is extended in order to maximize the space (or volume) within the portable structure without diminishing structural integrity. Vertical member 14 (and each vertical member 12, 16, 18, 20, and 22 of the portable structure) is capable of telescopic expansion both in height and width.

More particularly, upright member 14 includes a pair of vertical posts 82 and 84 and horizontal braces 86 and 88 which together bound a substantially rectangular vertical perimeter with an interior volume 90. By way of example, the dimensions of a collapsed upright member in a preferred embodiment are 8' on the horizontal 86 and 88 and slightly less than 8' on the vertical 82 and 84.

Vertical posts 82 and 84 include a female slide adjustor segment 92 and 94, respectively, and a male slide adjustor segment 96 and 98. Male slide adjustor segments 96 and 98 telescope within female slide adjustor segments 92 and 94 respectively.

When male slide adjustor segments 96 and 98 are telescoped out of female slide adjustor segments 92 and 94 to a desired expanded height, shown in phantom as 100, male slide adjustor segments 96 and 98 are secured in place. Male slide adjustor segments 96 and 98 may be secured in place by any suitable means, however, it has been found that a cage pin is particularly suited for this application.

In like manner, horizontal support 86 and 88 include a female slide adjustor segments 102 and 104 which receive a male slide adjustor segment. In the preferred embodiment, these male slide adjustor segments include an extension of male slide adjustor segment 96 on the above horizontal support 88 and extension of female slide adjustor segment 92 on the lower horizontal support 86. In this way, female slide adjustor segment 92 becomes the male slide adjustor segment on the lower horizontal support 86 which telescopes into female slide adjustor segment 104. When the horizontal supports are extended to the desired length, shown in phantom as 106, they are secured such as with a cage pin inserted into holes 108 and 110.

An expanded vertical member 14 having an increased height 100 and increased width 106 is obtained. By way of example for purpose of illustration, the expanded width 106 is expanded to 12' while the height 100 is expanded to almost 12'. The internal volume 90 is thus substantially increased. When each upright member 12, 14, 16, 18, 20, and 22 of FIG. 4 is extended, the resultant internal area defined within portable structure 10 enclosed by netting 76 is vastly increased.

When portable structure 10 is retracted for transport or storage, each vertical member, such as 14 of FIG. 5 is likewise reduced. The pins are removed and the male slide adaptor segments telescoped within their female slide adaptor segments to reduce the height of vertical posts 82 and 84 as well as the width of horizontal supports 86 and 88 are reduced to their original dimensions to facilitate transport and/or storage.

Each upright member is fitted with an extendable outrigger on each vertical post. In FIG. 5, upright member 14 includes an outrigger 112 which pivots from vertical post 82 and outrigger 114 which pivots from vertical post 84. Outrigger 112 is shown in its extended configuration while outrigger 114 is shown in its folded position within upright member 14.

Outriggers, such as outriggers 112 and 114, add increased stability to vertical posts 82 and 84 and thereby the entire portable structure.

Figure 6:
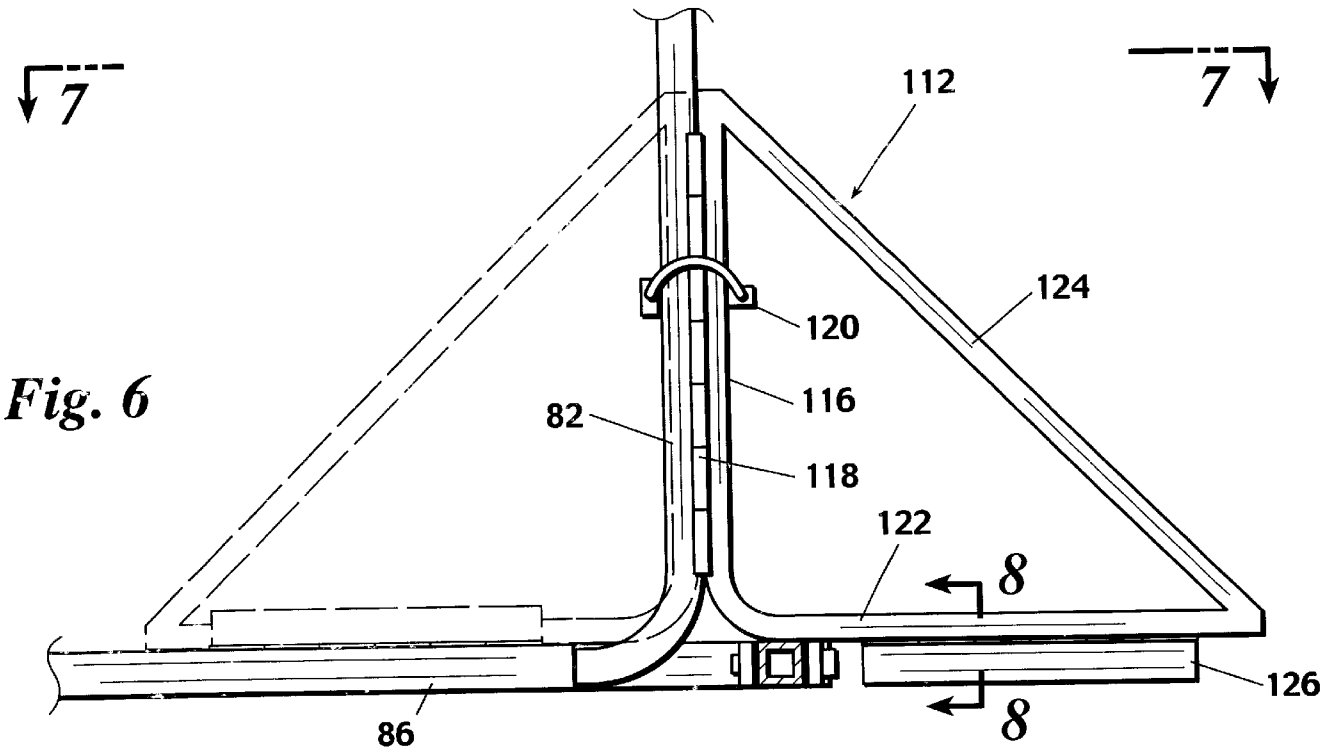
FIG. 6 is a detail view of the outrigger assembly.

FIG. 6 is a detail of outrigger assembly 112 of FIG. 5 which shall next be described. Outrigger 112 is of a substantially triangular geometry wherein one leg 116 is secured to vertical post 82 by hinge 118. Hinge 118 allows outrigger 112 to pivot from a first position shown in phantom to its extended position. Outrigger 112 is secured in this position using a cage pin 120.

A second leg 122 of outrigger 112 is parallel to the ground and horizontal support 86. However, in order for outrigger 112 to be capable of folding within upright member 12 (FIG. 5), it is necessary that leg 122 rotate to a position which is parallel to and rests upon horizontal support 86, shown in phantom. This being the case, when outrigger 112 is rotated outward from vertical post 82, a gap between leg 122 and the surface upon which horizontal support 86 rests is realized. In order to fill this gap, a spacer 126 is hinged to leg 122 such that when outrigger 112 is rotated outward from vertical post 82, spacer 126 is rotated around leg 122 thereby providing contact between outrigger 112 and the surface upon which horizontal support 86 rests. Outrigger 112 is then capable of providing support to upright member 12 (FIG. 5).

Figure 7:
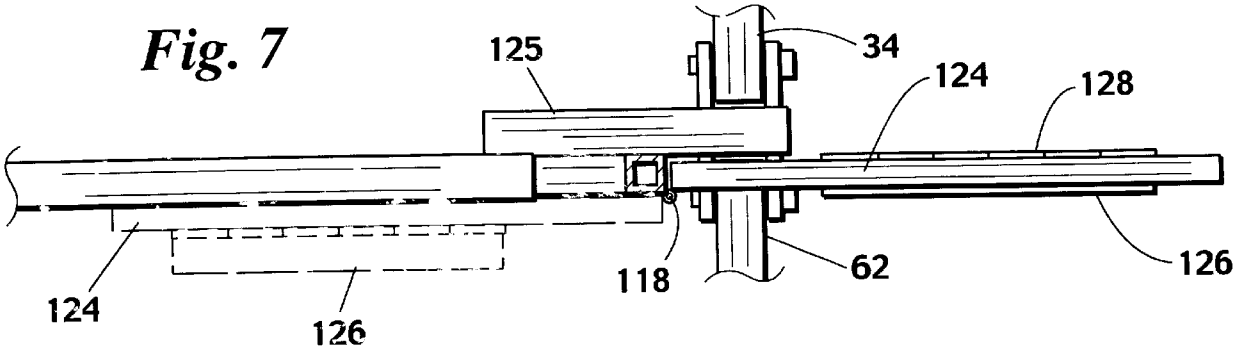
FIG. 7 is a view taken along line 7—7 of FIG. 6.

FIG. 7 shows outrigger 112 rotated out from upright 14 on hinge 118. Spacer 126 is shown rotated on hinge 128 from a position adjacent outrigger 112 as shown in phantom to a position under outrigger 112. Third leg 124 of outrigger 112 is shown from the top view.

A brace 125 extends from upright member 14 to which bracket 58 is secured. As stated above with regard to FIG. 2, bracket 58 are pivotally connected to articulated arms 34 and 62.

Figure 8:
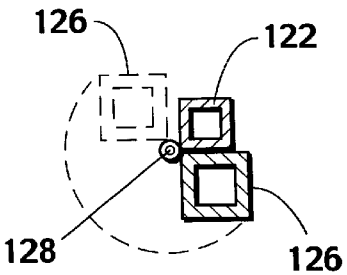
FIG. 8 is a view taken along line 8—8 of FIG. 6.

FIG. 8, a view taken along line 8—8 of FIG. 6, depicts the manner in which spacer 126 rotates upon hinge 128 around leg 122. Spacer 126 includes substantially the same dimensions as horizontal support 86. In the collapsed position, spacer 126 rotates on hinge 128 about leg 122 so as to be positioned adjacent leg 122 above horizontal support 86 as shown in phantom in FIG. 6 in combination with FIG. 8.

Figure 9:
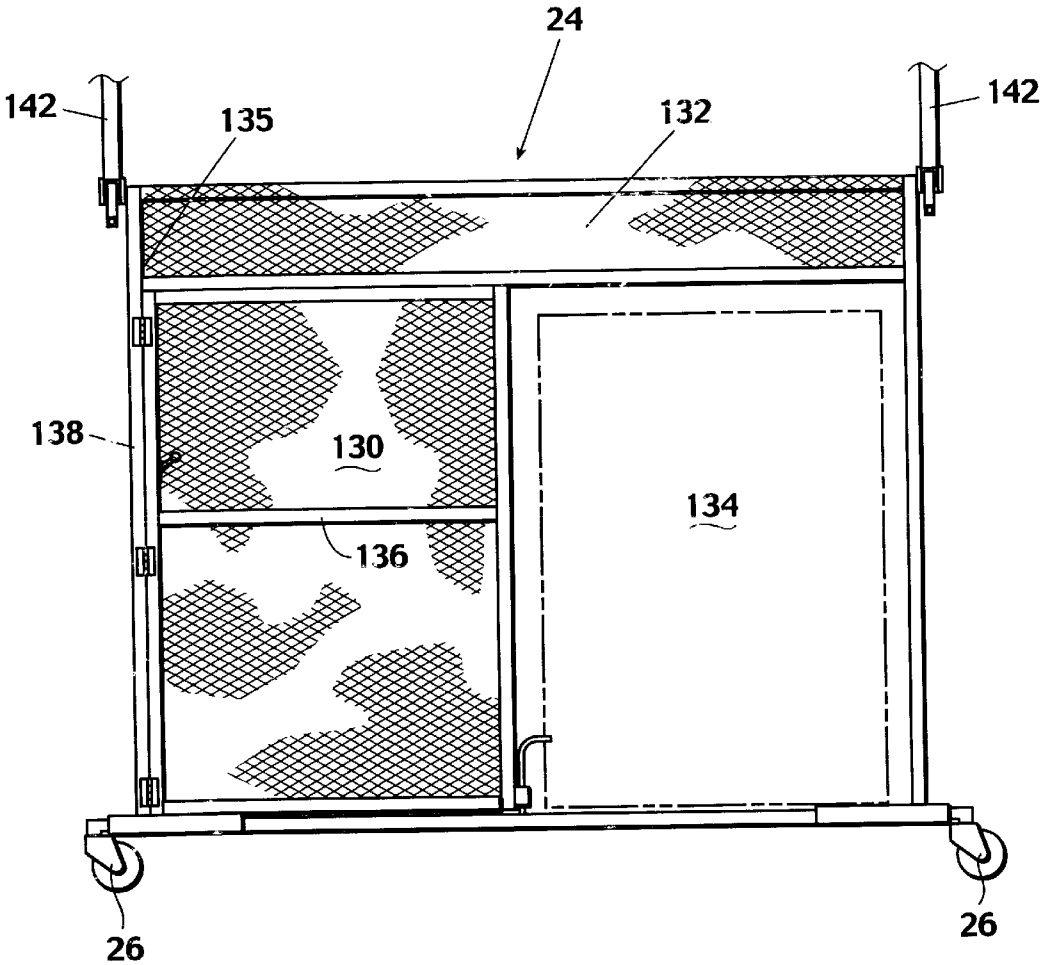
FIG. 9 is a back view of the portable structure detailing the storage container.
Figure 11:
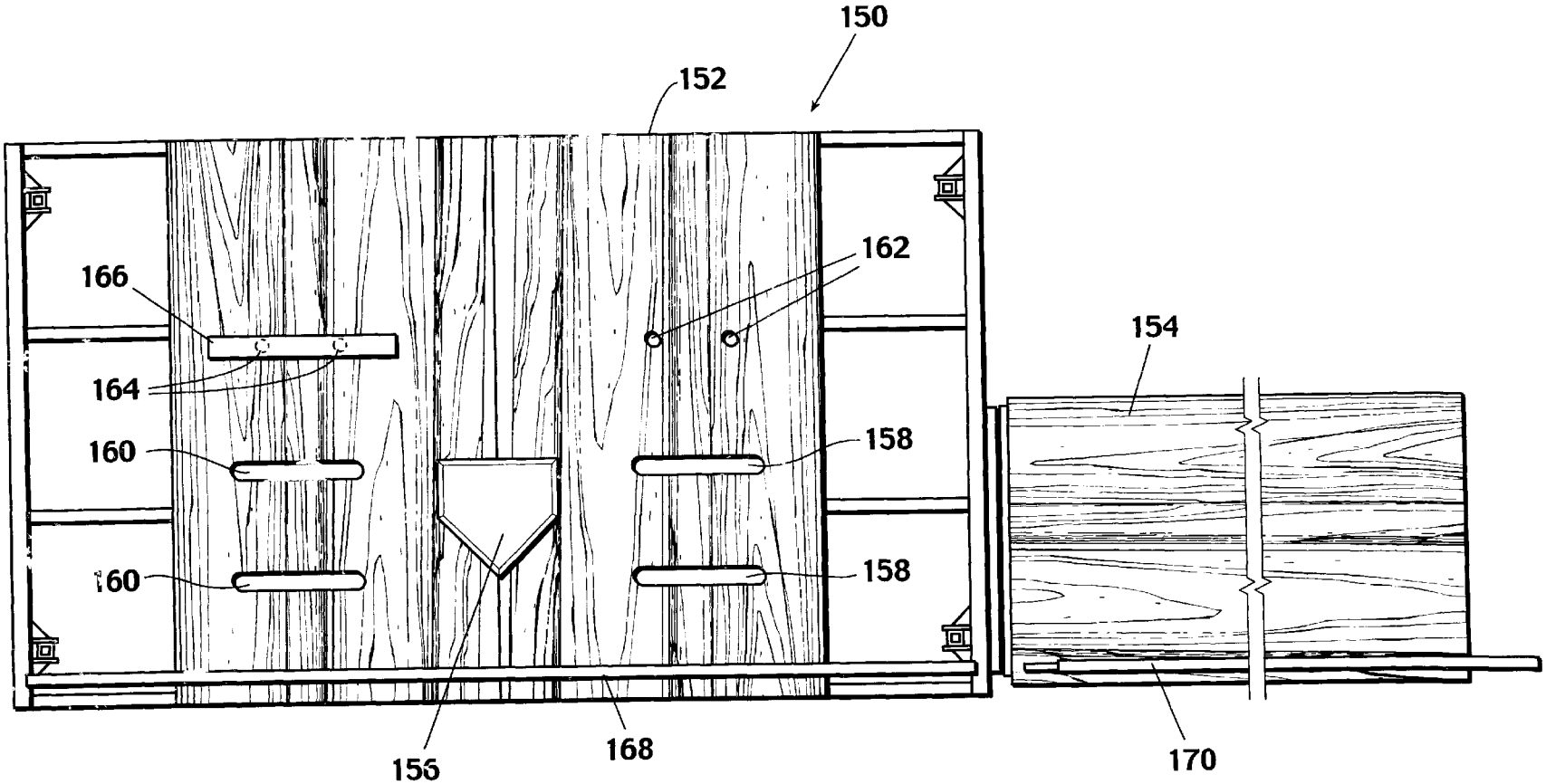
FIG. 11 is a top view of an alternate embodiment batting platform for use with the portable structure of the present invention configured to be wheelchair adaptable.

FIG. 9 is a back view of storage container 24 which shall next be described. Storage container 24 includes a general storage area 130, an overhead storage area 132 and a cut out area 134. Storage container 24 is a framed structure enclosed by wire mesh or other suitable material to provide low level security to its contents.

Figure 10:
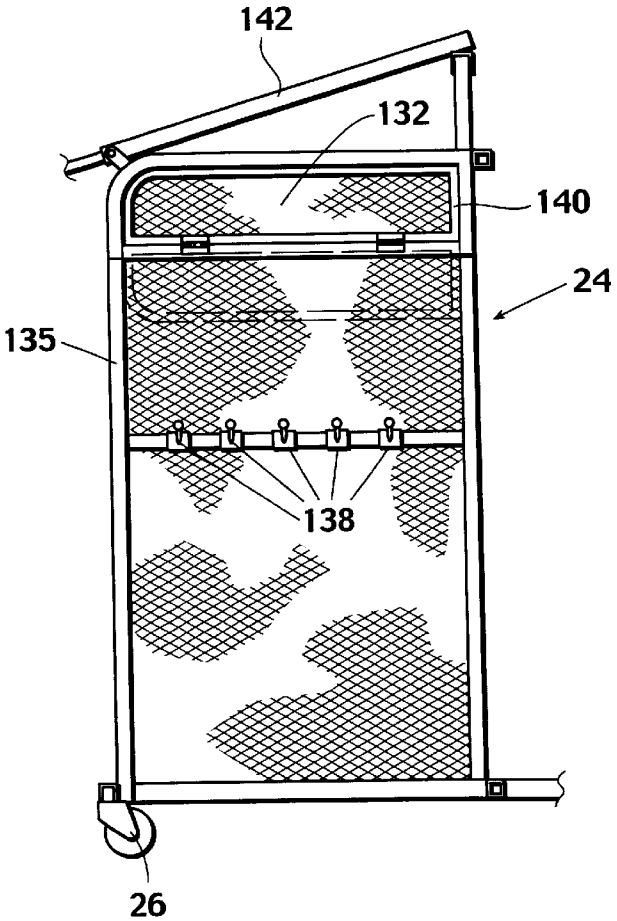
FIG. 10 is a side cross-sectional view of the storage container of FIG. 9 showing its interior.

General storage area 130 is secured by a hinged door 136 which provides access to its interior. General storage area 130 may be used to store a raised platform as discussed above with relation to FIG. 4 or any other sports or other equipment associated with the usage of the portable structure. General storage area 130 may also include a plurality of hooks 138 to retain tools and/or sporting equipment such as batting helmets, bats, bags, etc. Overhead storage area 132 extends the width of storage cabinet 24 and provides additional storage therein. In a preferred embodiment, the netting or fabric used to cover the portable structure is stored in overhead storage compartment 132. FIG. 10 is a cut-away view of the end 135 of FIG. 9 is shown. A hinged access door 140 provides security and access to the contents of overhead storage area 132. Hinged door 140 folds outward (as shown in phantom) to provide such access.

Hooks 138 are seen in greater detail in FIG. 10.

Referring back to FIG. 9, storage container 24 includes a space or area 134 which is open to provide access to the interior the portable structure or in the preferred embodiment batting cage, to receive an automatic pitching machine. Space 134 is positioned within storage container 24 so as to be in the center of the length of the interior of the portable structure when fully extended and expanded. Additional supports 142 are provided between the top of storage container 124 and expansion segment 11 (of FIG. 3). Structural members 142 provide additional rigid structural support to the portable structure. Structural members 142 are capable of telescopic extension to account for the increased distance created by the increase in the height of extension section 11 to which it is affixed. Structural members 142 are also capable of pivoting with respect to storage container 24 to account for the increase in the angle between structural support 142 and the top of storage container 24.

FIGS. 11–15 depict a specific embodiment batting platform (such as 78 of FIG. 4) which provides wheelchair accessibility to the interior of the portable structure when configured as a portable batting cage. Wheelchair accessible batting platform 150 includes, generally, a level foldable batting surface 152 and a wheelchair accessible ramp 154. Batting surface 152 includes a home plate 156 to provide the batter orientation with regard to the ball being pitched within the portable structure. Batting surface 152 additionally includes two cut our portions 158 and 160 in batting surface 152 at locations calculated to partially receive and retain therein wheels of a wheelchair. Holes 158 and 160 are calculated to be at the proper distance in orientation to home plate 156 such that when a batter using a wheelchair positions the large wheelchair wheels in either slots 158 or slots 160, the batter will be positioned in the proper location with respect to home plate and thereby the pitching machine.

Holes 158 are cut for use by a left handed batter, while holes 160 are contemplated for use by a right handed batter. An additional pair of holes 162 and 164 may be drilled in batting platform 152 so as to receive a shield or screen 166 therein. Shield 166 separates the batter from the path of errant incoming baseballs. Shield 166 may be positioned in either holes 164, as shown, or in holes 162 depending upon the batting orientation of the batter. Batting platform 152 also includes rail 168 and ramp 154 includes rail 170.

Figure 15:
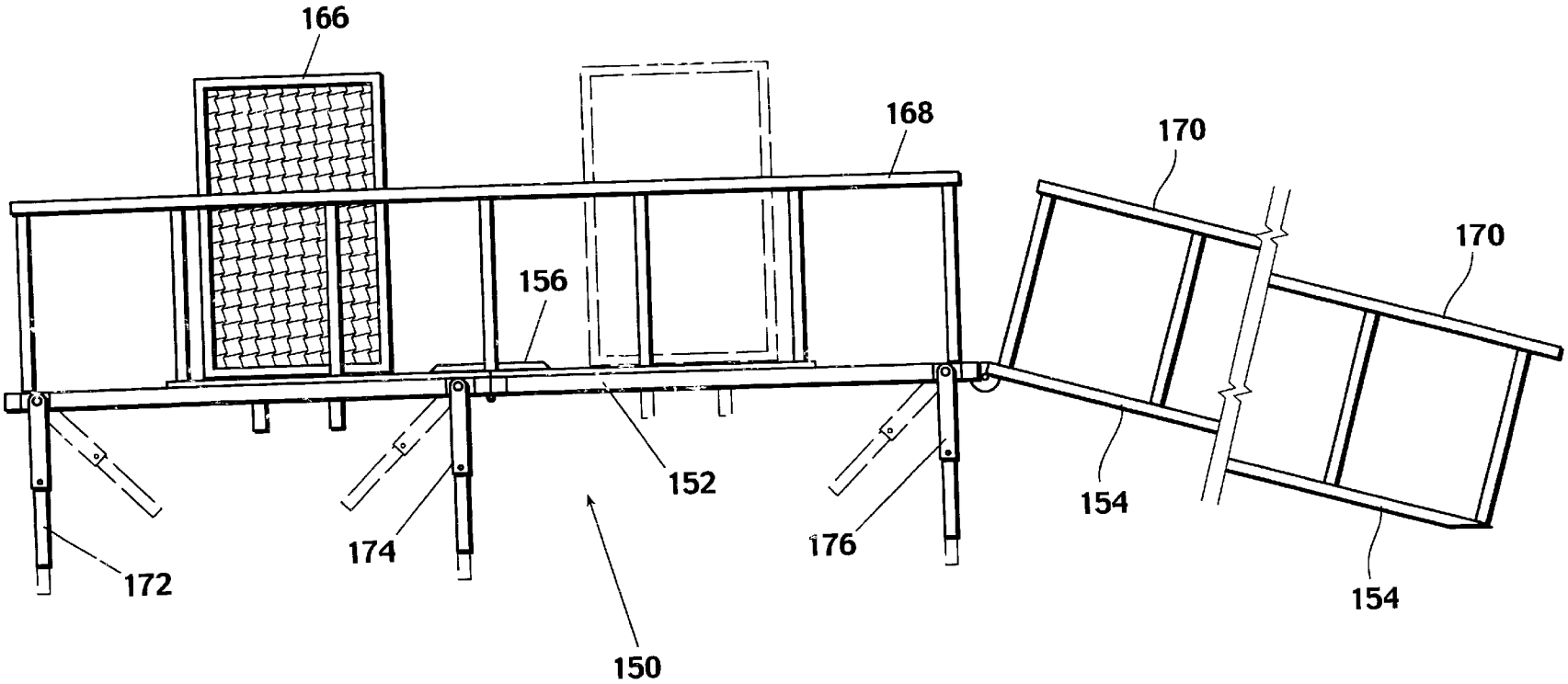
FIG. 15 is a side elevational view of the batting platform of FIG. 11 showing a wheelchair accessible ramp, side rails and removable shield.

Referring briefly to FIG. 15, a side elevation view of batting platform 150 depicting surface 152, ramp 154, home plate 156, rails 168 and 170, and shield 166. Shield 166 is shown extending through surface 152.

Ramp 154 is hinged from batting surface 152 and extends downwardly therefrom.

The folding operation of batting platform 152 shall be discussed in relation to FIGS. 11–15.

Figure 12:
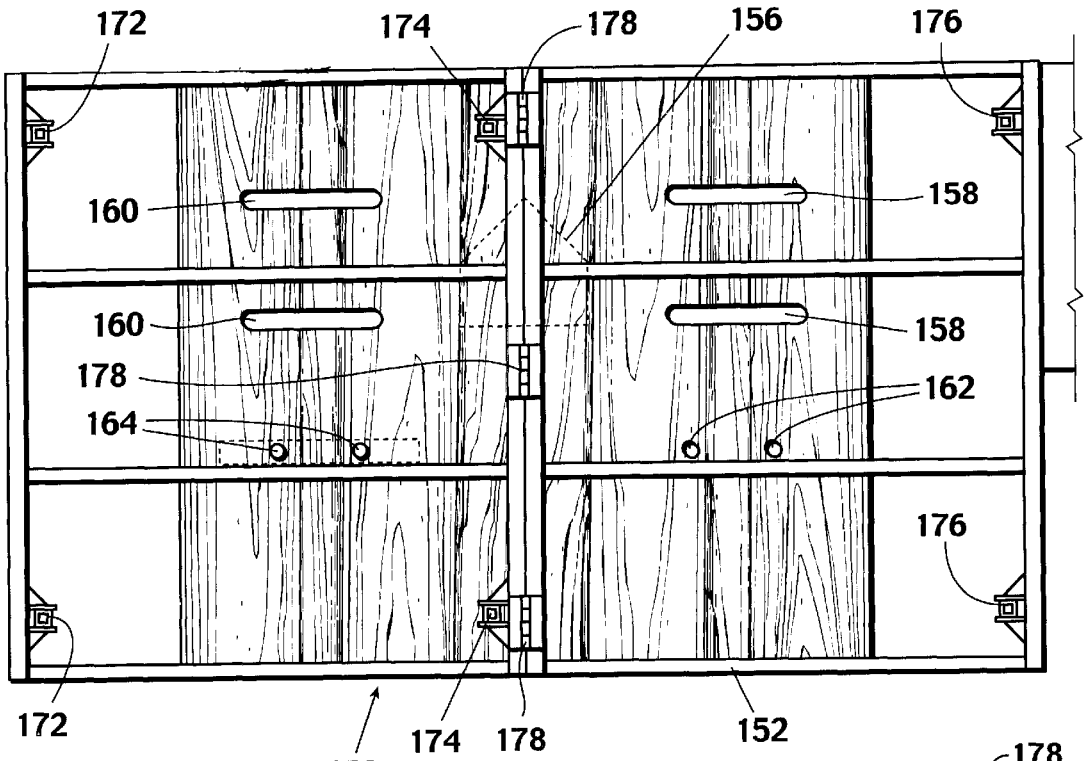
FIG. 12 is a bottom view of the batting platform of FIG. 11.

FIG. 12 is a bottom view of batting surface 152 which shows the manner in which it is hinged to include hinges 178. Hinges 178 divide batting surface 152 into two sections for storage and transport.

Figure 13:
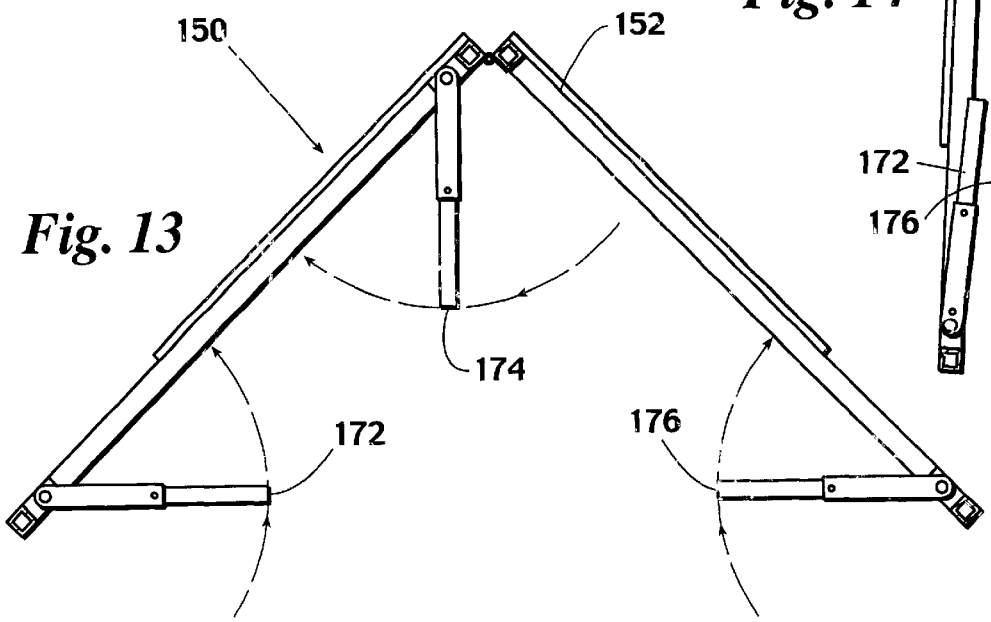
FIG. 13 is an end elevational view of the batting platform of FIG. 11 depicting the manner in which it may be folded for storage and transport.

FIG. 13 depicts batting surface 152 in the folding process wherein batting surface 152 is folded along hinges 178. Legs 172, 174, and 176 pivot in relation to batting surface 152 so as to to rotate flush therein as shown in phantom. Legs 172, 174, and 176 are each segmented so as to be capable of retraction in length when folded.

Figure 14:
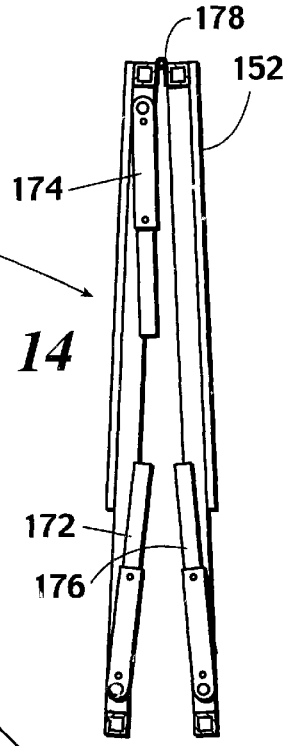
FIG. 14 is the end elevational view of the batting platform of FIG. 13 shown in its folded state for storage and transport.

FIG. 14 depicts batting surface 152 fully folded such that batting surface 152 is divided along hinges 178 and legs 172, 174, and 176 are retracted in length and folded flush with batting surface 152. It is understood that legs 172, 174, and 176 represent a pair of legs as shown in greater detail in FIG. 12. In FIG. 15, legs 172, 174, and 176 are shown pivoted outward so as to support batting surface 152 and extended to a maximum height. Thus, a foldable, portable batting platform which provides wheelchair access is provided.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A portable structure, comprising:

an expansion section capable of being in a collapsed state and an expanded state and being defined by a plurality of expansion segments, each of said plurality of expansion segments having a first and a second upright member each having an upper portion having an upper end and a lower portion having a lower end;

a first articulated arm having a first and a second articulated arm end, pivotally secured to said upper end of said first upright member at said first articulated arm end, and pivotally secured to said upper end of said second upright member at said second articulated arm end;

a second articulated arm having a first and a second articulated arm end, pivotally secured to said lower end of said first upright member at said first articulated arm end and pivotally secured to said lower end of said second upright member at said second articulated arm end;

said first and said second articulated arms including an elbow between said first articulated arm end and said second articulated arm end such that said first articulated arm end is capable of folding adjacent said second articulated arm end and unfolding in a scissor type motion thereby extending said first upright member away from said second upright member;

a netting positioned over said plurality of expansion segments;

a plurality of large wheels removably secured on said expansion section while said expansion section is in said collapsed state to define a transportation position;

a plurality of smaller wheels removably secured to each of said plurality of expansion segments such that when said large wheels are removed, said expansion section rests upon said smaller wheels to define an expansion position;

when said expansion section is in said expanded state said small wheels may be removed to define a structural position;

a substantially triangular member pivotally secured to each of said upright members, said substantially triangular member having a substantially vertical side, a substantially horizontal side and a diagonal side forming a substantially right triangle;

said substantially vertical side secured to one of said upright members.

2. The portable structure of claim 1 wherein said substantially vertical side is secured to said upper portion of one of said upright members and said substantially horizontal side is secured to said first articulated arm pivotally secured to said upright member.

3. A portable structure, comprising:

an expansion section capable of being in a collapsed state and an expanded state and being defined by a plurality of expansion segments, each of said plurality of expansion segments being having a first and a second upright member each having an upper portion having an upper end and a lower portion having a lower end;

a first articulated arm having a first and a second articulated arm end, pivotally secured to said upper end of said first upright member at said articulated arm end, and pivotally secured to said upper end of said second upright member at said second articulated arm end;

a second articulated arm having a first and a second articulated arm end, pivotally secured to said lower end of said first upright member at said first articulated arm end and pivotally secured to said lower end of said second upright member at said second articulated arm end;

said first and said second articulated arms including an elbow between said first articulated arm end and said second articulated arm end such that said first articulated arm end is capable of folding adjacent said second articulated arm end and unfolding in a scissor type motion thereby extending said first upright member away from said second upright member;

an upper cable system connected proximate to each of said upper end of each of said upright members;

a lower cable system connected proximate to each of said lower end of each of said upright members;

a netting being secured to said upper cable system and said lower cable system to cover said expansion section;

a plurality of large wheels removably secured on said expansion section while said expansion section is in said collapsed state to define a transportation position;

a plurality of smaller wheels removable secured to each of said plurality of expansion segments such that when said large wheels are removed, said expansion section rests upon said smaller wheels to define an expansion position, wherein said expansion section is in said expanded state said small wheels being removed to define a structural position;

a storage container for storing said expansion section while said expansion section is in said collapsed state;

a substantially triangular member pivotally secured to each of said upright members, said substantially triangular member having a substantially vertical side, a substantially horizontal side and a diagonal side forming a substantially right triangle;

said substantially vertical side secured to one of said upright members.

4. The portable structure of claim 3 wherein said substantially vertical side is secured to said upper portion of one of said upright members and said substantially horizontal side is secured to said first articulated arm pivotally secured to said upright member.

5. A portable structure, comprising:

an expansion section capable of being in a collapsed state and an expanded state and being defined by a plurality of expansion segments, each of said plurality of expansion segments being having a first and a second upright member each having an upper portion having an upper end and a lower portion having a lower end;

a first articulated arm having a first and a second articulated arm end, pivotally secured to said upper end of said first upright member at said articulated arm end, and pivotally secured to said upper end of said second upright member at said second articulated arm end;

a second articulated arm having a first and a second articulated arm end, pivotally secured to said lower end of said first upright member at said first articulated arm end and pivotally secured to said lower end of said second upright member at said second articulated arm end;

said first and said second articulated arms including an elbow between said first articulated arm end and said second articulated arm end such that said first articulated arm end is capable of folding adjacent said second articulated arm end and unfolding in a scissor type motion thereby extending said first upright member away from said second upright member; and an upper cable system connected proximate to each of said upper end of each of said upright members;

a lower cable system connected proximate to each of said lower end of each of said upright members;

a netting being secured to said upper cable system and said lower cable system to cover said expansion section;

a plurality of large wheels removably secured on said expansion section while said expansion section is in said collapsed state to define a transportation position;

a plurality of smaller wheels removable secured to each of said plurality of expansion segments such that when said large wheels are removed, said expansion section rests upon said smaller wheels to define an expansion position, wherein said expansion section is in said expanded state said small wheels being removed to define a structural position;

a storage container for storing said expansion section while said expansion section is in said collapsed state; and a platform positioned within said expansion section.

6. The portable structure of claim 5 wherein said platform is raised.

7. A portable structure comprising:

an expansion section having a plurality of upright members each of which at least partially define an area;

articulating arms connecting each of said plurality of upright members, said articulating arms for allowing said plurality of upright members to be selectively positioned with respect to one another for selectively expanding or contracting said expansion section in a longitudinal direction;

wherein at least some of said upright members are expandable in a vertical direction and a horizontal direction for increasing said area defined by said upright members, thereby increasing a volume defined by said plurality of upright members after said expansion section has been expanded;

wherein each of said plurality of upright members comprise an upper horizontal brace, a first vertical post, a second vertical post, a first adjuster segment in adjustable communication with said upper horizontal brace and said first vertical post, a second adjuster segment in adjustable communication with said upper horizontal brace and said second vertical post, and said first adjuster segment and said second adjuster segment for facilitating telescopic expansion of said upright members in said vertical direction and said horizontal direction.

8. A portable structure comprising:

an expansion section having a plurality of upright members each of which at least partially define an area;

articulating arms connecting each of said plurality of upright members, said articulating arms for allowing said plurality of upright members to be selectively positioned with respect to one another for selectively expanding or contracting said expansion section in a longitudinal direction;

wherein at least some of said upright members are expandable in a vertical direction and a horizontal direction for increasing said area defined by said upright members, thereby increasing a volume defined by said plurality of upright members after said expansion section has been expanded; and further comprising a platform positioned within said expansion section wherein said platform defines a pair of elongate holes sized to receive a lower portion of wheels of a wheel chair.

9. A portable structure comprising:

an expansion section having a plurality of upright members each of which at least partially define an area;

articulating arms connecting each of said plurality of upright members, said articulating arms for allowing said plurality of upright members to be selectively positioned with respect to one another for selectively expanding or contracting said expansion section in a longitudinal direction;

wherein at least some of said upright members are expandable in a vertical direction and a horizontal direction for increasing said area defined by said upright members, thereby increasing a volume defined by said plurality of upright members after said expansion section has been expanded; and further comprising a bar located proximate said plurality of upright members when said upright members are in a contracted position, said bar defining a plurality of holes therein;

a removable pin insertable within each of said holes, each of said pins for engagement with an upright member for selective retention of said upright member.

* * * * *